US006918264B2

(12) United States Patent
Park et al.

(10) Patent No.: US 6,918,264 B2
(45) Date of Patent: Jul. 19, 2005

(54) MULTI-TYPE AIR CONDITIONER

(75) Inventors: Jong Han Park, Gwangmyeong-si (KR); Young Min Park, Incheon-si (KR); Chang Seon Lee, Seoul (KR); Sung Oh Choi, Gwangmyeong-si (KR); Sung Chun Kim, Seoul (KR); Seung Yong Chang, Seoul (KR); Seok Ho Yoon, Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 10/682,972

(22) Filed: Oct. 14, 2003

(65) Prior Publication Data

US 2004/0134215 A1 Jul. 15, 2004

(30) Foreign Application Priority Data

Jan. 13, 2003 (KR) ..... P2003-0002035

(51) Int. Cl.[7] ..... F25B 13/00; F25B 41/00

(52) U.S. Cl. ..... 62/324.1; 62/324.6; 62/160; 62/197; 62/513

(58) Field of Search ..... 62/324.6, 324.1, 62/513, 504, 510, 498, 160, 197, 278, 468; 236/49.3

(56) References Cited

U.S. PATENT DOCUMENTS 5,297,392 A * 3/1994 Takata et al. ..... 62/160
5,309,733 A * 5/1994 Hayashida et al. ..... 62/278

FOREIGN PATENT DOCUMENTS

| | | |
|---|---|---|
| EP | 0485203 | 5/1992 |
| EP | 0496505 | 7/1992 |
| EP | 0974792 | 1/2000 |
| EP | 1162414 | 12/2001 |
| JP | 5-099525 | 4/1993 |
| JP | 10-054616 | 2/1998 |
| WO | 01181834 | 11/2001 |

OTHER PUBLICATIONS

English Language Abstract of JP 10–054616.
English Language Abstract of JP 5–099525.

* cited by examiner

*Primary Examiner*—Chen Wen Jiang
(74) *Attorney, Agent, or Firm*—Greenblum & Bernstein, P.L.C.

(57) ABSTRACT

Multi-type air conditioner including an outdoor unit having a compressor, an outdoor heat exchanger, a flow path control valve for controlling a flow path of the refrigerant from the compressor, an outdoor expansion device for expanding liquid refrigerant introduced thereto in a condensed state via indoor units and providing to the outdoor heat exchanger when the room is heated, and an outdoor unit piping system, a plurality of indoor units each having an indoor expansion device, an indoor heat exchanger, and an indoor piping system, a distributor for selectively distributing the refrigerant from the outdoor unit to the indoor units and returning to the outdoor unit again proper to respective operation modes, and means for super cooling the refrigerant condensed at the outdoor heat exchanger or the indoor heat exchangers and flowed to the indoor expansion devices or to the outdoor expansion device, thereby super cooling the refrigerant supplied to the evaporator.

24 Claims, 8 Drawing Sheets

MULTI-TYPE AIR CONDITIONER

This application claims the benefit of the Korean Application No. P2003-0002035 filed on Jan. 13, 2003, which is hereby incorporated by reference.

BACKGROUND OF THE INVENTION

1. Field of the Invention

The present invention relates to multi-type air conditioners, and more particularly, to a multi-type air conditioner which can cool or heat a plurality of rooms, individually.

2. Background of the Related Art

In general, the air conditioner is an appliance for cooling or heating spaces, such as living spaces, restaurants, and offices. At present, for effective cooling or heating of a space partitioned into many rooms, it is a trend that there has been ceaseless development of multi-type air conditioner. The multi-type air conditioner is in general provided with one outdoor unit and a plurality of indoor units each connected to the outdoor unit and installed in a room, for cooling or heating the room while operating in one of cooling or heating mode.

However, since the multi-type air conditioner is operative only in one mode of cooling or heating uniformly even if some of the many rooms within the partitioned space require heating, and rest of the rooms require cooling, the multi-type air conditioner has a limit in that the requirement can not be met, properly.

For an example, even in one building, there are rooms having a temperature difference depending on locations of the rooms or time of the day, such that while a north side room of the building requires heating, a south side room of the building requires cooling due to the sun light, which can not be dealt with a related art multi-type air conditioner that is operative in a single mode.

Moreover, even though a building equipped with a computer room requires cooling not only in summer, but also in winter for solving the problem of heat load of the computer related equipment, the related art multi-type air conditioner can not deal with such a requirement, properly.

In conclusion, the requirement demands development of multi-type air conditioner of concurrent cooling/heating type, for making air conditioning of rooms individually, i.e., the indoor unit installed in a room requiring heating is operable in a heating mode, and, at the same time, the indoor unit installed in a room requiring cooling is operable in a cooling mode.

SUMMARY OF THE INVENTION

Accordingly, the present invention is directed to a multi-type air conditioner that substantially obviates one or more of the problems due to limitations and disadvantages of the related art.

An object of the present invention is to provide a multi-type air conditioner, which can heat or cool rooms individually proper to room requirements at the same time, and in which introduction of two phased refrigerant into an expansion device of an indoor unit is prevented, for preventing deterioration of cooling performance and occurrence of noise.

Additional features and advantages of the invention will be set forth in the description which follows, and in part will be apparent to those having ordinary skill in the art upon examination of the following or may be learned from practice of the invention. The objectives and other advantages of the invention will be realized and attained by the structure particularly pointed out in the written description and claims hereof as well as the appended drawings.

To achieve these objects and other advantages and in accordance with the purpose of the present invention, as embodied and broadly described herein, the multi-type air conditioner includes an outdoor unit having a compressor, an outdoor heat exchanger, a flow path control valve for controlling a flow path of the refrigerant from the compressor, an outdoor expansion device for expanding liquid refrigerant introduced thereto in a condensed state via indoor units and providing to the outdoor heat exchanger when the room is heated, and an outdoor unit piping system, a plurality of indoor units each having an indoor expansion device, an indoor heat exchanger, and an indoor piping system, a distributor for selectively distributing the refrigerant from the outdoor unit to the indoor units and returning to the outdoor unit again proper to respective operation modes, and means for super cooling the refrigerant condensed at the outdoor heat exchanger or the indoor heat exchangers and flowed to the indoor expansion devices or to the outdoor expansion device.

The means includes a super cooling heat exchanger designed so as to heat exchange with a part of a pipeline between the outdoor expansion device and the indoor expansion devices in a pipeline the outdoor heat exchanger, the outdoor expansion device, the indoor expansion devices and the indoor heat exchangers connected in series.

Preferably, the super cooling heat exchanger uses a part of refrigerant flowing through the refrigerant pipe for super cooling rest of refrigerant passing through a part where the rest of refrigerant heat exchanges with the super cooling heat exchanger.

To do this, the means further includes a first guide pipe connected between the refrigerant pipeline and one end of the super cooling heat exchanger for guiding a portion of refrigerant flowing through the liquid refrigerant pipeline after passed through the indoor heat exchanger or the indoor heat exchanger, a super cooling expansion device mounted on the first guide pipe for expanding the refrigerant flowing through the first guide pipe, and a second guide pipe connected between the inlet of the compressor and the other end of the super cooling heat exchanger for guiding the refrigerant passed through the super cooling heat exchanger to the compressor.

In the meantime, the means further includes a supplementary super cooling heat exchanger mounted on a refrigerant pipeline between the super cooling heat exchanger and the outdoor expansion device. In this case, the means further includes a first supplementary guide pipe connected between the refrigerant pipeline and one end of the supplementary super cooling heat exchanger, a supplementary super cooling expansion device on the first supplementary guide pipe, and a second supplementary guide pipe connected between the inlet of the compressor and the other end of the supplementary super cooling heat exchanger.

The super cooling heat exchanger surrounds an outside surface of the refrigerant pipeline. The super cooling heat exchanger passes through an inside of the refrigerant pipeline. The super cooling heat exchanger includes many bends inside of the refrigerant pipeline for enlarging an area of heat exchange with the refrigerant flowing through the refrigerant pipeline.

In the meantime, the flow path control valve includes a first port in communication with the compressor, a second port in communication with the outdoor heat exchanger, a third port in communication with an inlet of the compressor, and a fourth port connected to a closed pipe piece or blanked.

The outdoor unit piping system includes a first pipeline connected between an outlet of the compressor and the first port, a second pipeline connected between the second port and the first port of the outdoor unit, the second pipeline having the outdoor heat exchanger mounted in the middle thereof, a third pipeline connected between the first pipeline and the second pipeline of the outdoor unit, and a fourth pipeline connected between the third port and the inlet of the compressor, having the third port of the outdoor unit connected to the middle thereof.

The first port of the outdoor unit is connected to the first port of the distributor, the second port of the outdoor unit is connected to the second port of the distributor, and the third port of the outdoor unit is connected to the third port of the distributor.

In the meantime, the distributor includes a distributor piping system for guiding refrigerant from the outdoor unit to the indoor units, and vice versa, and a valve bank mounted on the distributor piping system for controlling flow of refrigerant flowing through the distributor piping system proper to respective operation modes.

The distributor piping system includes a liquid refrigerant pipeline having a first port of the distributor, a plurality of liquid refrigerant branch pipelines branched from the liquid refrigerant pipeline and connected to the indoor unit expansion devices in the indoor units respectively, a gas refrigerant pipeline having a second port of the distributor, a plurality of first gas refrigerant branch pipelines branched from the gas refrigerant pipeline and connected to the indoor heat exchangers of the indoor units respectively, a plurality of second gas refrigerant branch pipelines branched from intermediate points of the first gas refrigerant branch pipelines respectively, a return pipeline having all the second gas refrigerant pipelines connected thereto, and a third port of the distributor.

When the air conditioner of the present invention has the foregoing system, it is preferable that the super cooling heat exchanger is mounted at a part where the liquid refrigerant pipeline and the liquid refrigerant branch pipeline join. It is preferable that the first guide pipe is branched from the liquid refrigerant pipeline and connected to the super cooling heat exchanger, and the second guide pipe is connected to the return pipeline.

In the meantime, in another aspect of the present invention, there is provided a multi-type air conditioner including an outdoor unit having a compressor, and an outdoor heat exchanger, a plurality of indoor units each connected to the outdoor unit directly having an indoor expansion device, and an indoor heat exchanger, and a super cooling heat exchanger mounted on a refrigerant pipeline between the outdoor heat exchanger and the indoor expansion device in the refrigerant pipeline connecting the outdoor heat exchanger, the indoor expansion devices, and the indoor heat exchangers in series, for super cooling the refrigerant.

It is to be understood that both the foregoing description and the following detailed description of the present invention are exemplary and explanatory and are intended to provide further explanation of the invention claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE PREFERRED EMBODIMENT

Reference will now be made in detail to the preferred embodiments of the present invention, examples of which are illustrated in the accompanying drawings. In describing the embodiments of the present invention, same parts will be given the same names and reference symbols, and repetitive description of which will be omitted.

Figure 1:
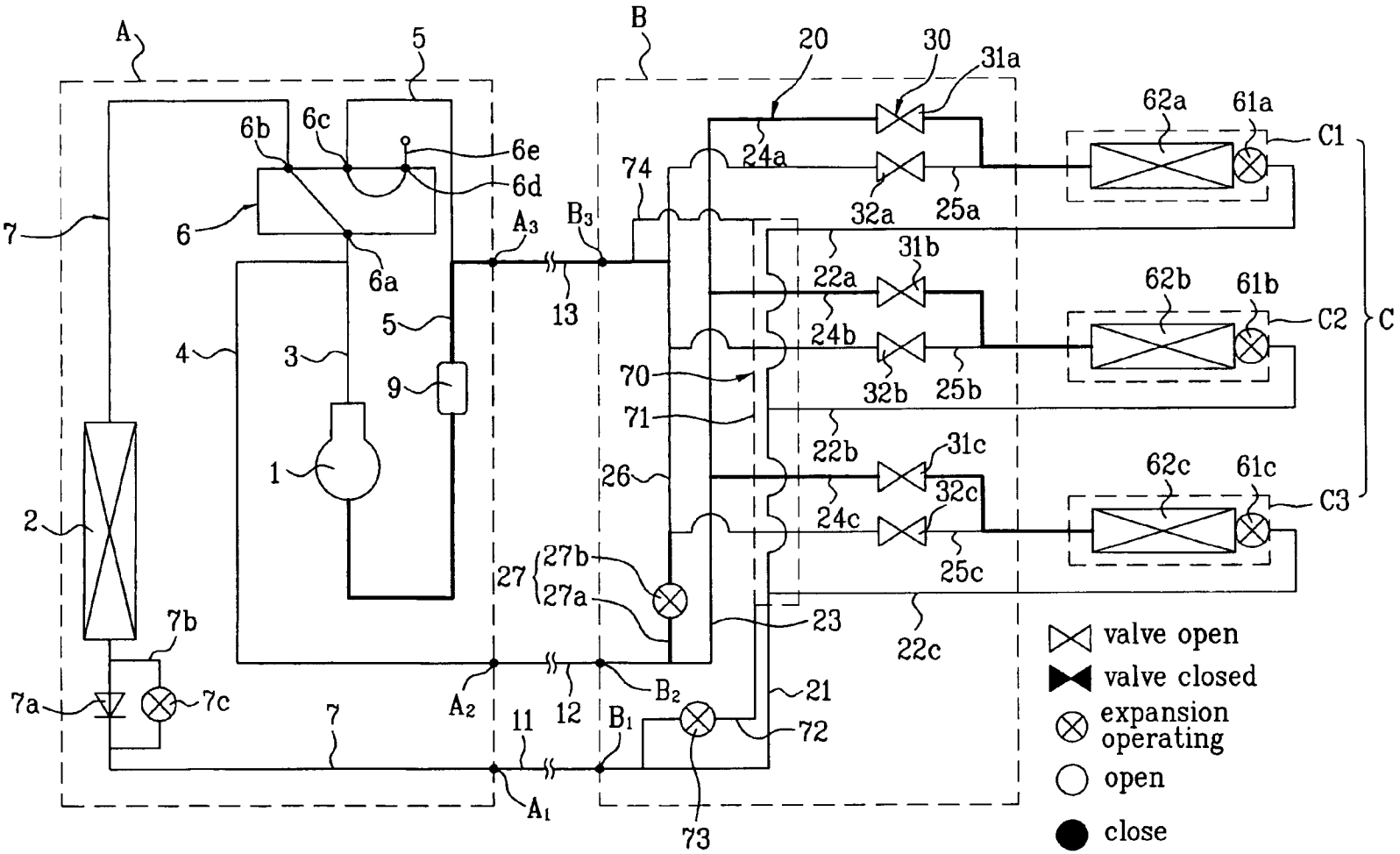
FIG. 1 illustrates a system of a multi-type air conditioner in accordance with a preferred embodiment of the present invention.

Referring to FIG. 1, the air conditioner includes an outdoor unit 'A', a distributor 'B', and a plurality of indoor units 'C'; 'C1', 'C2', and 'C3'. The outdoor unit 'A' has a compressor 1, an outdoor heat exchanger 2, a flow path control valve 6, and an outdoor unit piping system, and the distributor 'B' has a distribution piping system 20, and a valve bank 30. Each of the indoor units 'C'; has an indoor heat exchanger 62 and indoor unit expansion device 61. Moreover, the air conditioner of the present invention includes super cooling means 70 additionally for enhancing an air conditioning efficiency and reducing noise and occurrence of out of order of the air conditioner.

The air conditioner has a system in which rooms the indoor units 'C'; 'C1', 'C2', and 'C3' are installed therein respectively are cooled or heated individually according to different operation modes of a first operation mode of cooling all rooms, a second operation mode of heating all rooms, a third operation mode of cooling a major number of the rooms and heating a minor number of rooms, and a fourth operation mode of heating a major number of the rooms and cooling a minor number of rooms, detail of one preferred embodiment of which will be described with reference to FIG. 1.

For convenience of description, the following drawing reference symbols, 22 represents 22*a*, 22*b*, and 22*c*, 24 represents 24*a*, 24*b*, and 24*c*, 25 represents 25*a*, 25*b*, and 25*c*, 31 represents 31*a*, 31*b*, and 31*c*, 32 represents 32*a*, 32*b*, and 32*c*, 61 represents 61*a*, 61*b*, and 61*c*, 62 represents 62*a*, 62*b*, and 62*c*, and C represents C1, C2, and C3. Of course, a number of the indoor units 'C' and numbers of elements related thereto are varied with a number of rooms, and for convenience of description, the specification describes assuming a case when there are three rooms, i.e., a number of the indoor units are three.

The outdoor unit 'A' of the air conditioner of the present invention will be described. Referring to FIG. 1, there is a first pipeline 3 connected to an outlet of the compressor 1. The first pipeline 3 is connected to the flow path control valve 4, which controls a flow path of gas refrigerant from the compressor 1 according to respective operation modes. The flow path control valve has four ports, of which first port 6*a* is connected to the first pipeline 3.

The second port 6*b* of the flow path control valve 4 is connected to a second pipeline 7. The second pipeline 7 has one end connected to the second port 6*b* of the flow path control valve 6, and the other end connected to a first port A1 of the outdoor unit 'A' as shown in FIG. 1. As shown in FIG. 1, there is the outdoor heat exchanger 2 in the middle of the second pipeline 7.

The third port 6*c* of the flow path control valve 6 is connected to a fourth pipeline 5. The fourth pipeline 5 has one end connected to the third port 6*c*, and the other end connected to an inlet of the compressor 1. An intermediate point of the fourth pipeline 5 is in communication with the third port A3 of the outdoor unit 'A'. In the meantime, an intermediate point of the fourth pipeline 5, in more detail, at a point between the inlet of the compressor 1 and the third port A3 of the outdoor unit 'A', there is an accumulator 9.

As shown in FIG. 1, the fourth port 6*d* of the flow path control valve 6 is connected to a pipe piece 6*e* with one blanked end. Or, the fourth port 6*d* may not be connected to the pipe piece, but the fourth port 6*d* itself may be closed.

The flow path control valve 6 makes the first port 6*a* and the second port 6*b* in communication and, at the same time with this, makes the third port 6*c* and the fourth port 6*d* in communication when the multi-type air conditioner is in operation in the first or third operation mode. Also, the flow path control valve 6 makes the first port 6*a* and the fourth port 6*d* in communication and, at the same time with this, makes the second port 6*b* and the third port 6*c* in communication when the multi-type air conditioner is in operation in the second or fourth operation mode. The refrigerant flow controlled thus by the flow path control valve 6 will be described in detail, later.

In the meantime, there is a third pipeline 4, one end of which is connected to the middle of the first pipeline 3. The other end of the third pipeline 4 is connected to a second port A2 of the outdoor unit 'A'. There is a check valve 7*a* on an intermediate point of the second pipeline 7, in more detail, a point between the outdoor heat exchanger 2 and the first port A1 of the outdoor unit 'A'. It is preferable that the check valve 7*a* is mounted adjacent to the outdoor heat exchanger 2. There is an outdoor unit expansion device 7*c* on the second pipeline 7 in parallel to the check valve 7*a*. For this, a parallel pipe piece 7*b* having two ends connected to an inlet and an outlet of the check valve 7*a* is provided, and the outdoor expansion device 7*c* is mounted on the parallel pipe piece 7*b*.

The check valve 7*a* passes refrigerant flowing from the outdoor heat exchanger 2 to the first port A1 of the outdoor unit 'A', and blocks refrigerant flowing from the first port A1 of the outdoor unit 'A' to the outdoor heat exchanger 2. Therefore, the refrigerant flowing from the first port A1 of the outdoor unit 'A' to the outdoor heat exchanger 2 bypasses the check valve 7*a* to pass through the parallel pipe 7*b* and the outdoor unit expansion device 7*c*, and therefrom flows into the outdoor heat exchanger 2.

In the meantime, if the outdoor expansion device 7*c* can open a flow passage, a function identical to above description can be made even if no check valve 7*a* is provided. That is, if the outdoor expansion device 7*c* opens a flow passage, when the refrigerant flows from the outdoor heat exchanger 2 toward the distributor 'B', and, if the outdoor expansion device 7*c* expands the refrigerant, when the refrigerant flows from the distributor 'B' toward the outdoor heat exchanger 2, the same function as the embodiment in which the check valve 7*a* is provided can be carried out.

The outdoor unit 'A' having the foregoing system is connected to the distributor 'B' with a plurality of connection pipelines. For this, of the connection pipelines, a first connection pipeline 11 connects the first port A1 of the outdoor unit 'A' to the first port B1 of the distributor 'B', and a second connection pipeline 12 connects a second port A2 of the outdoor unit 'A' and a second port B2 of the distributor 'B', and a third connection pipeline 13 connects a third port A3 of the outdoor unit 'A' and a third port B3 of the distributor 'B'. Accordingly, in the multi-type air conditioner of the present invention, the outdoor unit 'A' and the distributor 'B' are connected with three pipelines.

In the meantime, it is required that the distributor 'B' guides the refrigerant from the outdoor unit 'A' to selected indoor unit 'C' exactly. Moreover, it is required that the plurality of pipelines connecting the distributor 'B' to the plurality of indoor unit 'C' are simplified, for easy piping work and improving an outer appearance. As shown in FIG. 1, the distributor 'B' of the air conditioner of the present invention designed taken the foregoing matters into account includes the distributor piping system 20, and the valve bank 30.

The distributor piping system 20 guides refrigerant flow from the outdoor unit 'A' to the indoor units 'C', and vice versa. The distributor piping system 20 includes a liquid refrigerant pipeline 21, a plurality of liquid refrigerant branch pipelines 22, a gas refrigerant pipeline 23, and a plurality of first refrigerant branch pipelines 24, a plurality of second branch pipelines 25, and a return pipeline 26.

Referring to FIG. 1, the liquid refrigerant pipeline 21 provides a first port B1 of the distributor 'B' for connection to the first connection pipeline 11. The plurality of liquid refrigerant branch pipelines 22 are branched from the liquid refrigerant pipeline 21 and connected to the indoor unit expansion devices 61 in the indoor units 'C', respectively. The gas refrigerant pipeline 23 provides a second port B2 of the distributor 'B' for connection to the second connection pipeline 12. The plurality of first gas refrigerant branch pipelines 24 are branched from the gas refrigerant pipeline 23 and connected to the indoor heat exchangers 62 of the indoor units C, respectively. The plurality of second gas refrigerant branch pipelines 25 are branched from intermediate points of the first gas refrigerant branch pipelines 24 respectively. As shown in FIG. 1, the return pipeline 26 has all the second gas refrigerant pipelines 25 connected thereto. The return pipe 26 has a third port B3 of the distributor 'B'.

The valve bank 30 in the distributor 'B' controls refrigerant flow in the distributor piping system, such that gas or liquid refrigerant is introduced into the indoor units in the rooms selectively, and returns from the indoor units 'C' to the outdoor unit 'A'. As shown in FIG. 1, the valve bank 30 includes a plurality of open/close valves 31*a*, 31*b*, 31*c*, 32*a*, 32*b*, and 32*c* mounted on the first gas refrigerant branch pipelines 24 and the second gas refrigerant branch pipelines 25, respectively. The valves 31 and 32 open or close the first gas refrigerant branch pipelines 24 and the second gas refrigerant branch pipelines 25 respectively for controlling refrigerant flow paths according to the operation modes. In the meantime, detailed control of the valve bank 30 will be described in a description of operation of the air conditioner of the present invention for each operation mode.

The distributor 'B' of the multi-type air conditioner of the present invention may also include means 27 for preventing high pressure refrigerant staying in the second connection pipeline 12 from being liquefied when the multi-type air conditioner is in the first operation mode. Because there may be shortage of refrigerant for cooling or heating if the high pressure refrigerant is stagnant and liquefied in the second connection pipeline 12, the means 27 is provided to the distributor 'B' for vaporizing liquid refrigerant and preventing liquefaction of the high pressure refrigerant in the second connection pipeline 12 to prevent shortage of refrigerant in the air conditioner at the end. The means 27 includes a bypass pipe 27*a* connected between the return pipeline 26 and the gas refrigerant pipeline 23, and a distributor expansion device 27 on the bypass pipeline 27*a*. The operation of the means 27 will be described in detail, later.

In the meantime, the indoor unit 'C', installed in each room, includes the indoor heat exchanger 62, indoor unit expansion device 61, and room fan (not shown). The indoor heat exchanger 62 is connected to respective first gas refrigerant branch pipeline 24 in the distributor 'B', and the indoor unit expansion device 61 is connected to respective liquid refrigerant branch pipeline 22 in the distributor 'B'. The indoor heat exchangers 62 and the indoor unit expansion devices 61 are connected with refrigerant pipe. The room fan blows air to respective indoor heat exchanger 62.

Super cooling means provided to the multi-type air conditioner of the present invention will be described. Before starting description of a structure and mounting location of the super cooling means, necessity for the super cooling means will be described, briefly.

In general, the outdoor unit 'A' is installed on an outside of a building, such as a roof top of a building, while the indoor units C are installed at respective rooms in the building. The distributor 'B' is installed in the middle of the outdoor unit 'A' and the indoor units C, for an example, a space in the building, or an inside of ceiling. Thus, since the outdoor unit 'A' is installed substantially far from the indoor units 'C', there is a pressure drop taken place when the liquid refrigerant condensed at the outdoor unit 'A' or the indoor units 'C' moves to the indoor units 'C' or the outdoor unit 'A', to cause expansion of a portion of the refrigerant.

If two phased refrigerant having gas and liquid mixed therein caused by the expansion of a portion of the refrigerant is introduced into the outdoor expansion device 7*c* or the indoor expansion device 61, it is liable that noise, malfunction, or out of order may take place when the refrigerant expands. Moreover, a poor expansion efficiency is caused, resulting in a poor air conditioning efficiency. Therefore, in order to solve this problem, an improvement plan is required for super cooling the refrigerant condensed at the outdoor heat exchanger 2 or at the indoor heat exchangers 62 and supplying to the indoor expansion devices 61 or the outdoor expansion device 7*c*.

In order to solve the foregoing problem, the multi-type air conditioner of the present invention includes the super cooling means 70, additionally. Referring to FIG. 1, it is preferable that the super cooling means 70 is mounted on the distributor 'B', for super cooling the refrigerant condensed at the outdoor heat exchanger 2 or the indoor heat exchangers 62 and flows toward the indoor expansion devices 61 or the outdoor expansion device 7*c*. The super cooling means 70 includes a super cooling heat exchanger 71.

The super cooling heat exchanger 71 is designed so as to heat exchange with a part of a pipeline between the outdoor expansion device 7*c* and the indoor expansion devices 61 in a pipeline the outdoor heat exchanger 7*c*, the outdoor expansion device 7*c*, the indoor expansion devices 61 and the indoor heat exchangers connected in series. In more detail, as shown in FIG. 1, the super cooling heat exchanger 71 is mounted on a part the liquid refrigerant branch pipeline 22 is branched from the liquid refrigerant pipeline 21.

The super cooling heat exchanger 71 mounted thus cools down the refrigerant passing through the super cooling heat exchanger 71, resulting to super cool the refrigerant. For cooling the refrigerant passing through the part the super cooling heat exchanger 71 is mounted thereon, a variety of method can be employed. That is, cold air may be blown toward the super cooling heat exchanger 71, or cooling fluid, such as cooling water, may be supplied thereto, for cooling the refrigerant passing through the super cooling heat exchanger 71. However, the present invention suggests, not employment of separate cooling fluid, but use of a portion of the refrigerant flowing in the refrigerant pipeline, i.e., the liquid refrigerant pipeline 21 for cooling the refrigerant passing through the super cooling heat exchanger 71.

To do this, the super cooling heat exchanger 71 includes a first guide pipe 72 for guiding a portion of refrigerant flowing through the liquid refrigerant pipeline 21 to the super cooling heat exchanger 71, a super cooling expansion device 73 for expanding the refrigerant flowing through the first guide pipe 72, and a second guide pipe 74 for guiding the refrigerant passed through the super cooling heat exchanger 71 to the inlet of the compressor 1. The liquid refrigerant pipeline 21 has one end connected to a point where the first port B1 of the distributor 'B' and the liquid branch pipeline 22 are branched, and the other end connected to one end of the super cooling heat exchanger 71. As shown in FIG. 1, the super cooling expansion device 73 is mounted on the first guide pipe 72. As shown in FIG. 1, the second guide pipe 74 has one end connected to the other end of the super cooling expansion device 73, and the other end connected to the return pipeline 26. Thus, when the other end of the second guide pipe 74 is connected to the return pipeline 26, the refrigerant passed through the super cooling expansion device 73 is introduced into the inlet of the compressor 1 via the return pipeline 26 and the fourth pipeline 5. In the meantime, the second guide pipe 74 may be connected to the fourth pipeline 5, directly.

Figure 4A:
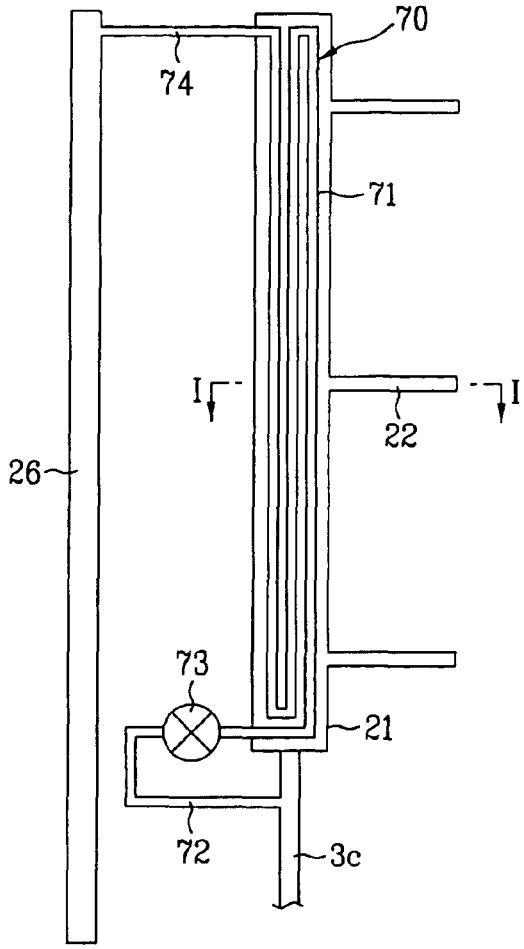
FIG. 4A illustrates a super cooling means in FIG. 4A, schematically.
Figure 4B:
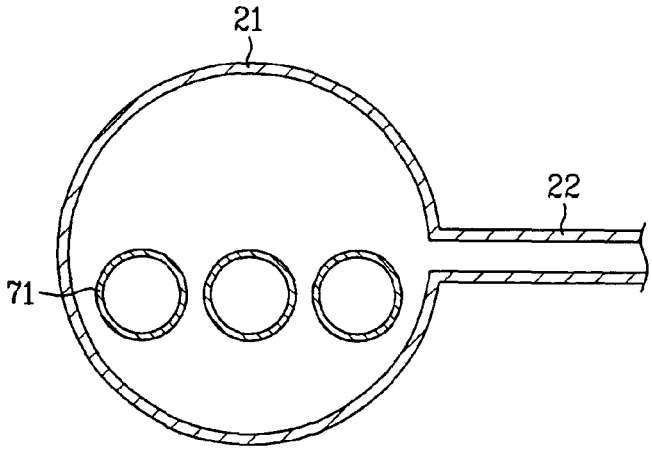
FIG. 4B illustrates a section across a line I—I in FIG. 4A.

Referring to FIG. 4A, the super cooling heat exchanger 71 may be positioned inside of the liquid refrigerant pipeline 21. In this instance, as shown in FIGS. 4A and 4B, it is preferable that the super cooling heat exchanger 71 is bent many times in the liquid refrigerant branch pipeline 22 for enlarging a heat exchange area with the refrigerant flowing in the liquid refrigerant pipeline 21 and the liquid refrigerant branch pipelines 22. Since the refrigerant flowing through the liquid refrigerant pipeline 21 becomes to contact with the super cooling heat exchanger 71 directly if the super cooling heat exchanger 71 has above form, the refrigerant flowing through the liquid refrigerant pipeline 21 becomes to heat exchange with the refrigerant flowing through the super cooling heat exchanger 71, effectively.

In the meantime, though FIGS. 4A and 4B illustrate an embodiment in which the liquid refrigerant pipeline 21 surrounds the super cooling heat exchanger 71, opposite to this, the liquid refrigerant pipeline 21 may pass through an inside of the super cooling heat exchanger 71. Through not shown, this embodiment can be known to persons in this field of art without any further description.

Figure 6:
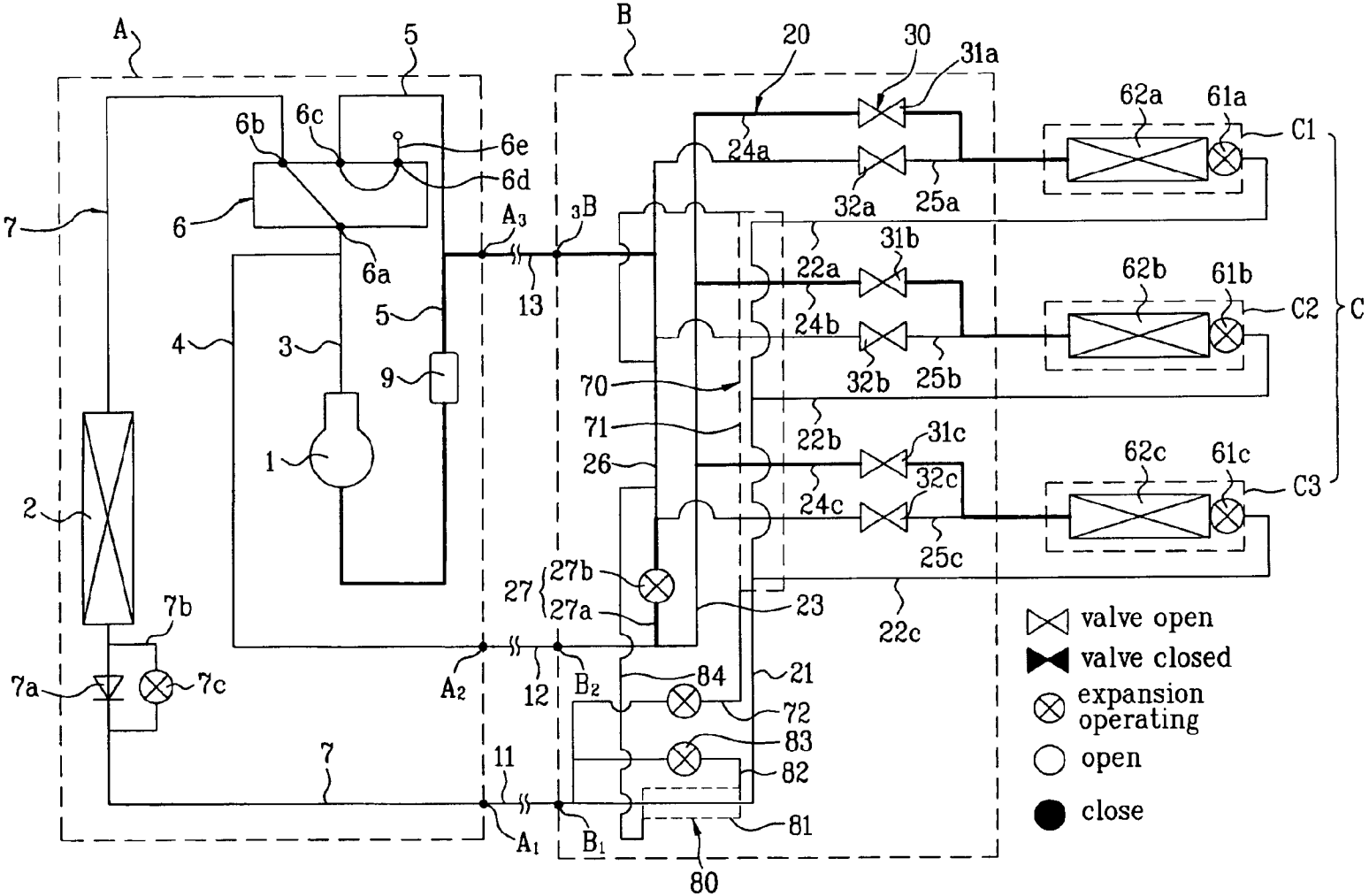
FIG. 6 illustrates a system of a multi-type air conditioner in accordance with another preferred embodiment of the present invention.

Referring to FIG. 6, for more positive super cooling of the refrigerant, another super cooling means 80 may be further provided to the air conditioner of the present invention. The super cooling means 80 includes a super cooling heat exchanger 81, a first guide pipe 82, a super cooling expansion device 83, and a second guide pipe 84. Description of a structure and connection of the super cooling means 80, similar to the super cooling means 70 described before, will be omitted. However, as shown in FIG. 6, the super cooling heat exchanger 81 is mounted between the first port B1 of the distributor 'B' and the super cooling heat exchanger 71. If the two super cooling heat exchangers 71 and 81 are provided to the air conditioner of the present invention, it is preferable that the super cooling heat exchanger 71 is operated in all operation modes. However, the super cooling heat exchanger 81 is operated only in the first operation mode for prevention of drop of an air conditioning performance.

Figure 5:
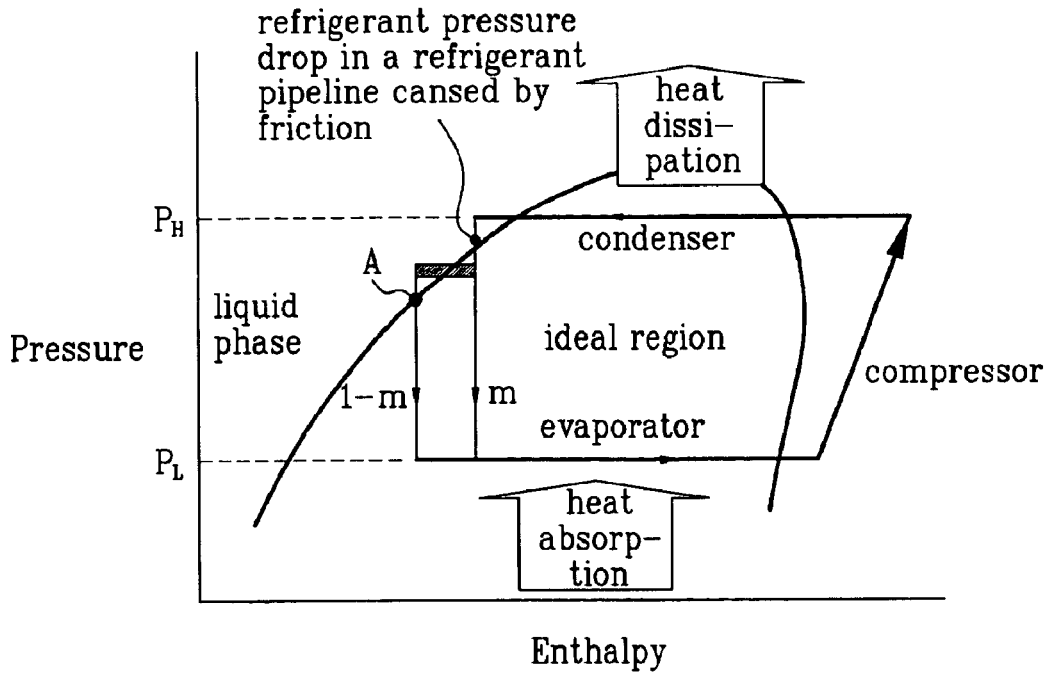
FIG. 5 illustrates a P-h diagram showing a super cooling principle of the super cooling means in FIG. 1.

Referring to FIG. 5, a principle in which the refrigerant flowing through the liquid refrigerant is super cooled by the supper cooling means 70 will be described. For reference, FIG. 5 illustrates a P-h diagram showing a super cooling principle of the super cooling means in FIG. 1. For the description will proceed with reference to an embodiment in which the outdoor heat exchanger 2 serves as a condenser, and the indoor heat exchanger 62 serves as an evaporator.

At first, the refrigerant is compressed to a high pressure at the compressor 1, and transferred to the outdoor heat exchanger 2 in FIG. 1 which serves as a condenser, where the refrigerant discharges heat at a fixed pressure, and condensed into liquid refrigerant. The refrigerant liquefied at the outdoor heat exchanger 2 is transferred to the distributor 'B' via the second pipeline 7 in FIG. 1. In this instance, since the refrigerant pipeline connected between the outdoor heat exchanger 'A' and the distributor 'B', i.e., the first connection pipeline 11 is long, a pressure of the refrigerant in the first connection pipeline 11 drops due to friction taken place in the first connection pipeline 11. As a portion of the refrigerant expands while the pressure of the refrigerant drops, the refrigerant becomes a two phased state as shown in FIG. 5.

A portion 'm' of mass of the two phased refrigerant flowing through the first connection pipeline 11 is introduced into the first guide pipe 72, and rest of the mass (1-m) is introduced into the liquid refrigerant pipeline 21. The portion of mass 'm' of the refrigerant introduced into the first guide pipe 72 is expanded completely at the super cooling expansion device 73, heat exchanges at the super cooling heat exchanger 71 with the rest '1-m' of mass of the refrigerant flowing through the liquid refrigerant pipeline 21, and vaporizes. In this instance, the rest of mass '1-m' of the refrigerant flowing through the liquid refrigerant pipeline 21 supplies vaporizing heat to the portion 'm' of mass of the refrigerant flowing through the super cooling heat exchanger 71. Therefore, as shown in FIG. 5, the rest '1-m' of mass of the refrigerant flowing through the liquid refrigerant pipeline 21 is super cooled as the rest '1-m' of mass of the refrigerant is involved in temperature drop with reduced enthalpy under isobaric condition. According to this, entire refrigerant introduced into the indoor expansion device 61 via the liquid refrigerant pipeline 21 becomes a liquid state. In the meantime, in above process, the super cooling heat exchanger 71 serves as an evaporator for evaporating the portion 'm' of mass of the refrigerant.

The rest '1-m' of mass of the liquid refrigerant super cooled through above process is expanded at the indoor expansion device 61, evaporated at the indoor heat exchanger 62, cools the room, transferred to the return pipeline 26, and introduced into the inlet of the compressor 1. On the other hand, the portion 'm' of mass of the refrigerant vaporized at the super cooling heat exchanger 71 is introduced into the inlet of the compressor 1 via the return pipeline 26.

In the multi-type air conditioner of the present invention, so as to be proper to respective operation modes, a flow path and a flow direction of the gas refrigerant from the compressor 1 are changed under the control of the flow path control valve 6 in the outdoor unit 'A', and a flow path and a flow direction of the gas refrigerant are changed under the control of the valve bank 30 both in the distributor 'B' and the indoor unit 'C', in individual heating or cooling of the rooms. Refrigerant flow under the control of the flow path control valve 6 and the valve bank 30 in the individual cooling or heating of the rooms will be described for each of the operation modes, hereafter. For convenience of description, it is assumed that two indoor units C1 and C2 cool the rooms, and the other one indoor unit C3 heat the room in the third operation mode. It is also assumed that two indoor units C1 and C2 heat the rooms and the other one indoor unit C3 cools the room in the fourth operation mode.

Figure 2A:
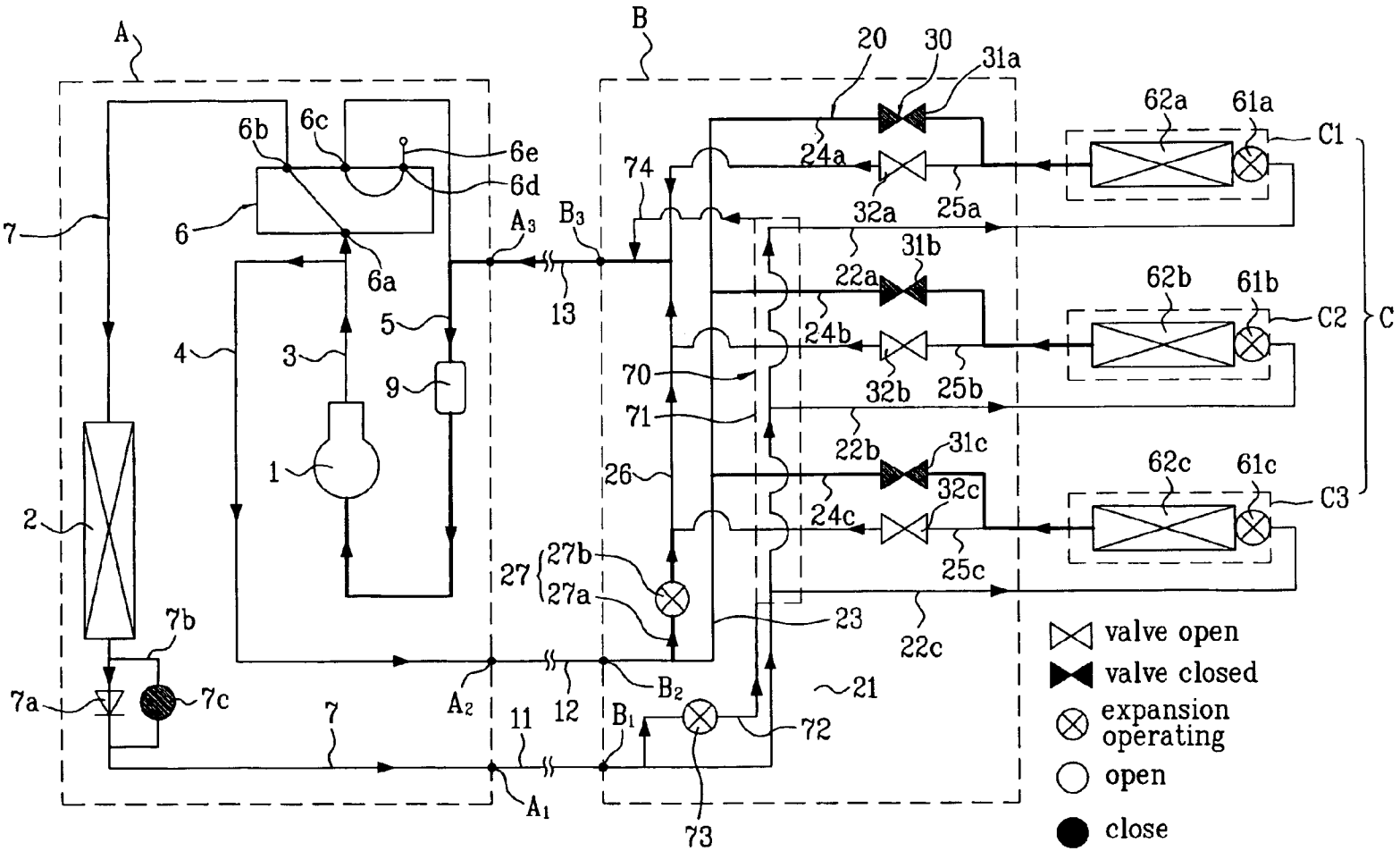
FIG. 2A illustrates a system showing operation of the system in FIG. 1 in cooling all rooms.

FIG. 2A illustrates a system showing operation of the system in FIG. 1 in cooling all rooms. In the first operation mode when all the indoor units cool the rooms, the flow path control valve 6 makes the first port 6*a* and the second port 6*b* in communication, and at the same time makes the third port 6*c* and the fourth port 6*d* in communication. Accordingly, most of the refrigerant from the outlet of the compressor 1 is introduced into the second pipeline 7 via the first pipeline 3. As shown in FIG. 2A, a portion of the refrigerant from the compressor 1 is introduced into the third pipeline 4 connected to the first pipeline 3. A refrigerant flow introduced into the second pipeline 7 from the compressor 1 will be described.

The refrigerant introduced into the second pipeline 7 heat exchanges with the external air, and condensed at the outdoor heat exchanger 2. The portion 'm' of mass of the condensed liquid refrigerant is introduced into the super cooling heat exchanger 71 through the first guide pipe 72, and the rest '1-m' of the condensed liquid refrigerant is introduced into the liquid refrigerant pipeline 21 in the distributor 'B', via the check valve 7*a*, the first port A1 of the outdoor unit 'A', and the first connection pipeline 11. As described with reference to FIG. 5, the rest '1-m' of the liquid refrigerant introduced into the liquid refrigerant pipeline 21 is super cooled into liquid fully as the rest '1-m' of the liquid refrigerant heat exchanges with the portion 'm' of the refrigerant flowing through the super cooling heat exchanger 71.

The portion of mass 'm' of the refrigerant vaporized as it passes through the super cooling heat exchanger 71 is introduced into the inlet of the compressor 1 via the second guide pipe 74, the return pipeline 26, and the fourth pipeline 5. The rest '1-m' of the refrigerant introduced from the liquid refrigerant pipeline 21 in the distributor 'B' is introduced into the indoor unit expansion devices 61 through the liquid refrigerant branch pipelines 22, respectively. The refrigerant expanded at the indoor unit expansion devices 61 heat exchanges at the indoor heat exchangers 62 to cool the rooms, respectively. In this instance, since the refrigerant supplied to the indoor expansion devices 61 is in a liquefied state by the super cooling means 70, expansion noise and out of order are reduced significantly compared to the related art.

In the first operation mode, the valve bank 30 in the distributor 'B' is controlled such that the valves 31*a*, 31*b* and 31*c* on the first gas refrigerant pipelines 24*a*, 24*b* and 24*c* are closed, and the valves 32*a*, 32*b*, and 32*c* on the second gas refrigerant pipelines 25*a*, 25*b*, and 25*c* are opened. Therefore, as shown in FIG. 2A, the gas refrigerant vaporized at the indoor heat exchangers 62 while cooling down the room air is introduced into the return pipeline 26 through the second gas refrigerant branch pipelines 25.

In the meantime, the refrigerant, discharged from the compressor 1 to the third pipeline 4, is introduced into the gas refrigerant pipeline 23 via the second port A2 of the outdoor unit 'A', the second connection pipeline 12, and the second port B2 of the distributor 'B'. In the meantime, as shown in FIG. 2A, since the valves 31*a*, 31*b*, and 31*c* mounted on the first gas refrigerant branch pipelines 24 connected to the gas refrigerant pipeline 23 are closed, the gas refrigerant introduced into the gas refrigerant pipeline 23 is guided to the bypass pipeline 27*a*, and, therefrom, flows to the return pipeline 26 after expanded at the distributor expansion device 27*b*. Accordingly, the means 27 prevents liquefaction of the gas refrigerant filled fully in the third pipeline 4 and the second connection pipeline 12 in a stagnant state, effectively.

The gas refrigerant joined at the return pipeline 26 is introduced into the fourth pipeline 5 via the third port B3 of the distributor 'B', the third connection pipeline 13, and the third port A3 of the outdoor unit 'A'. In the meantime, the third port 6*c* of the flow path control valve 6 one end of the fourth pipeline 5 is connected thereto is in communication with the fourth port 6*d* connected to the blanked pipe piece 6*e* in the first operation mode. Therefore, the refrigerant is introduced from the fourth pipeline 5 to the inlet of the compressor 1 via the accumulator 9.

Figure 2B:
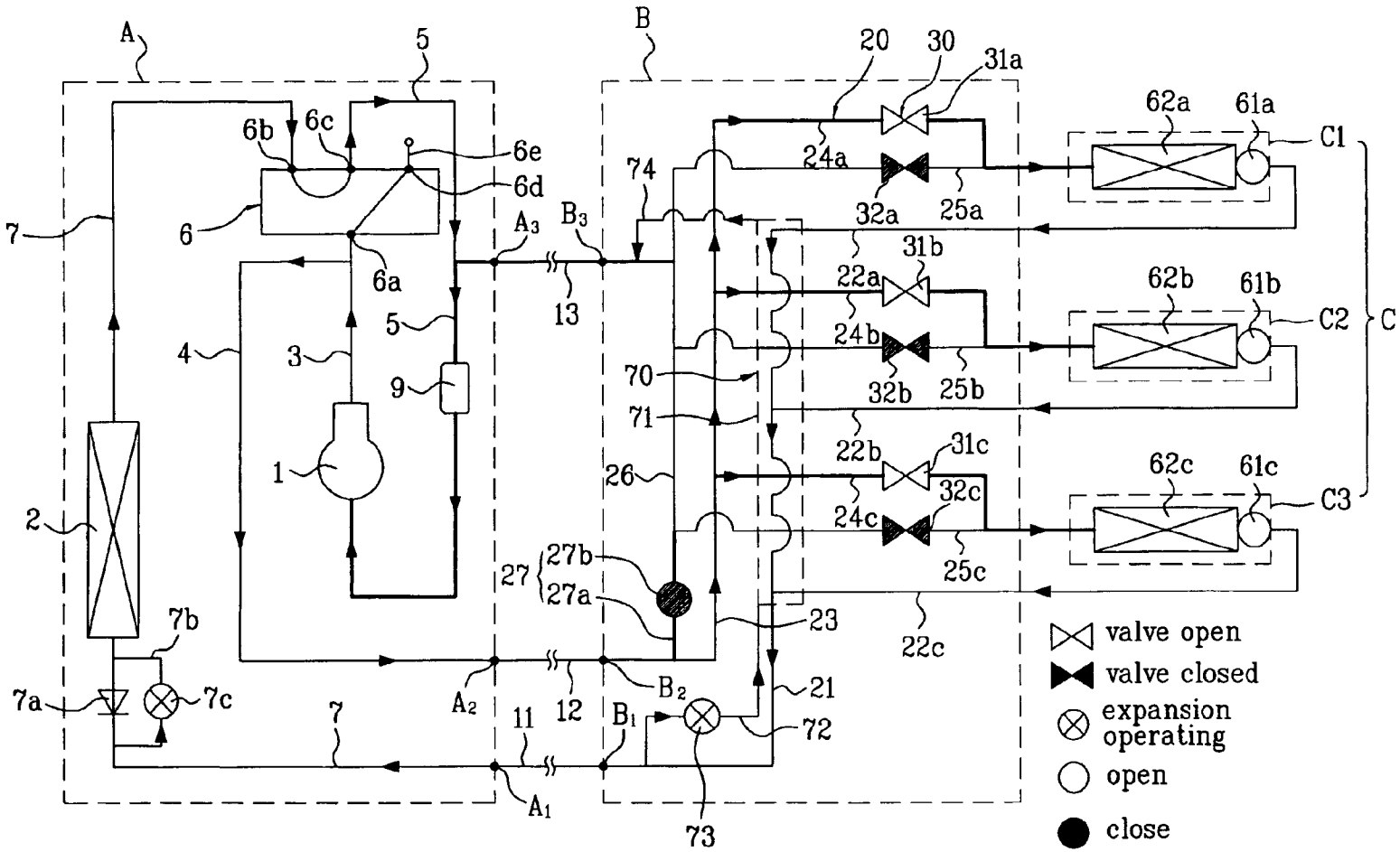
FIG. 2B illustrates a system showing operation of the system in FIG. 1 in heating all rooms.

FIG. 2B illustrates a system showing operation of the system in FIG. 1 in the second operation mode. In the second operation mode, when all rooms are heated, the flow path control valve 6 makes the first port 6*a* and the fourth port 6*d* in communication, and at the same time makes the second port 6*b* and the third port 6*c* in communication. According to this, as shown in FIG. 2B, entire refrigerant is introduced from the compressor 1 to the third pipeline 4 via the first pipeline 3. The gas refrigerant is introduced from the third pipeline 4 into the gas refrigerant pipeline 23 via the second port A2 of the outdoor unit 'A', the second connection pipeline 12, and the second port of the distributor 'B'.

In the second operation mode, the distributor expansion device 27*b* is closed, the valves 31*a*, 31*b*, and 31*c* on the first gas refrigerant branch pipelines 24 are opened, and the valve 32*a*, 32*b*, and 32*c* on the second gas refrigerant branch pipelines 25 are closed. Therefore, entire refrigerant introduced into the gas refrigerant pipeline 23 is introduced into the first gas refrigerant branch pipelines 24, and heat exchanges with room air, and is condensed at the indoor heat exchangers 62. In this instance, the indoor heat exchanger 62 discharges condensing heat, and the room fan (not shown) discharges the condensing heat into the room, to heat the room.

As shown in FIG. 2B, since the indoor unit expansion device 61 is opened in the second operation mode, the refrigerant condensed at the indoor heat exchanger 62 is introduced into the liquid refrigerant pipeline 21 through the liquid refrigerant branch pipelines 22. In this instance, as shown in FIG. 2B, the refrigerant flowing through the liquid refrigerant pipeline 21 heat exchanges with the super cooling heat exchanger 71, is super cooled, and introduced into the second pipeline 7 via the first port B1 of the distributor 'B', the first connection pipeline 11, and the first port A1 of the outdoor unit 'A'. The description of the principle of super cooling by the super cooling means 70, similar to the description made with reference to FIG. 5, will be omitted.

The refrigerant is introduced from the second pipeline 7 to the parallel pipe piece 7*b* under the guidance of the check valve 7*a*, and expanded at the outdoor expansion valve 7*c*. In this instance, the refrigerant introduced into the outdoor heat exchanger 7*c* is in a super cooled state by the super cooling means 70 fully, the noise and out of order of the outdoor expansion device 7*c* is reduced significantly. The refrigerant expanded at the outdoor expansion device 7*c* heat exchanges, and is vaporized at the outdoor heat exchanger 2. Then, the vaporized refrigerant is introduced into the fourth pipeline 5 guided by the flow path control valve 6, and enters into the inlet of the compressor 1 via the accumulator 9. In this instance, since the valves 32*a*, 32*b*, and 32*c* mounted on the second gas refrigerant branch pipelines 25 are closed, the refrigerant is only introduced from the fourth pipeline 5 to the compressor 1.

Figure 3A:
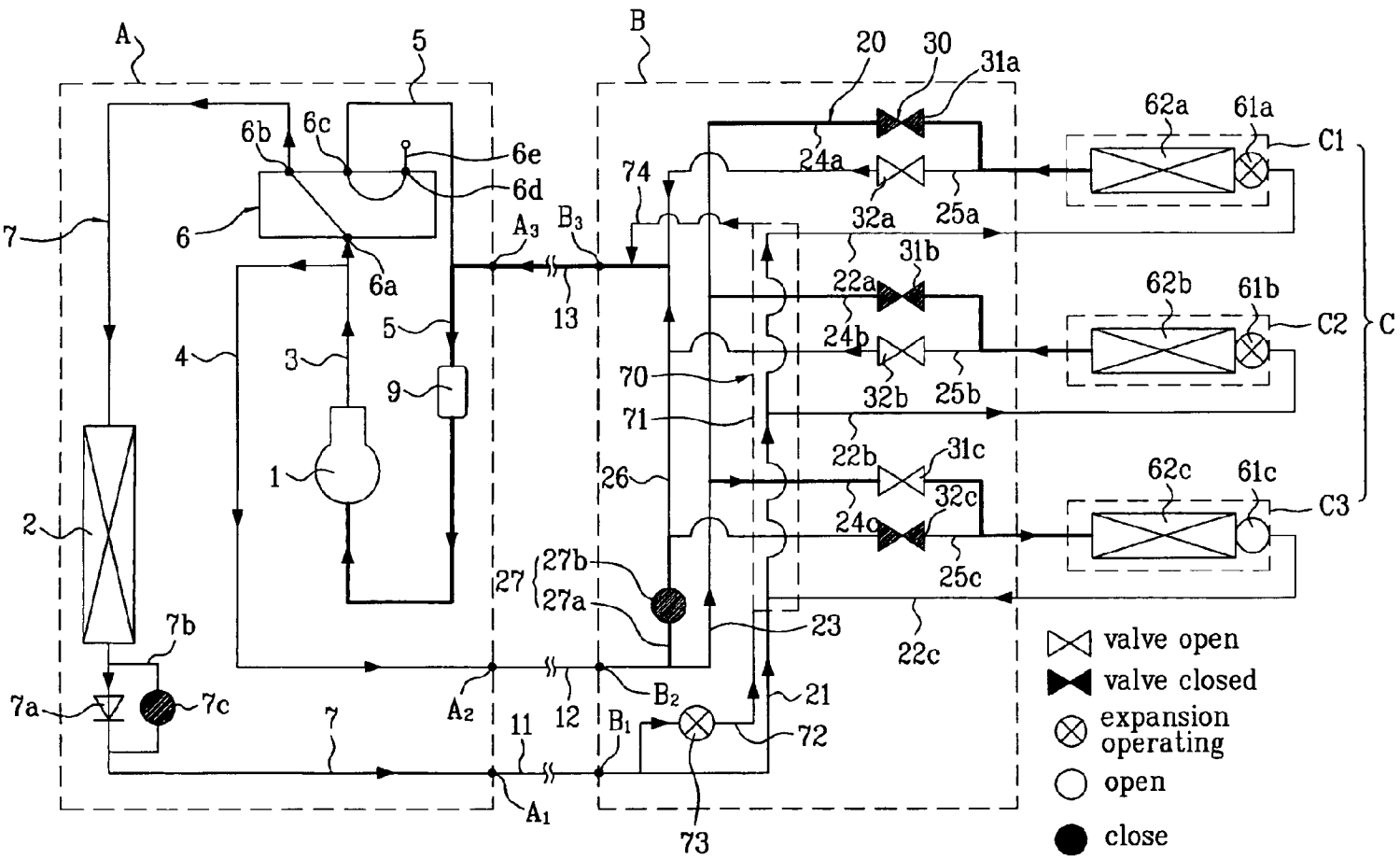
FIG. 3A illustrates a system showing operation of the system in FIG. 1 in cooling a major number of rooms and heating a minor number of rooms.

FIG. 3A illustrates a system showing operation of the system in FIG. 1 in the third operation mode. Identical to the first operation mode, in the third operation mode, when a major number of rooms are cooled, and a minor number of rooms are heated, the flow path control valve makes the first port 6*a* and the second port 6*b* in communication, and the third port 6*c* and the fourth port 6*d* in communication. Therefore, a portion of the refrigerant is introduced from the compressor 1 into he second pipeline 7, and the other portion is introduced into the third pipeline 4. Description of the process, identical to the refrigerant flow in the first operation mode described with reference to FIG. 2A, will be omitted.

In the third operation mode, the distributor expansion device 27*b* is closed. The valves 31*a* and 31*b*, mounted on the first gas refrigerant branch pipelines 24*a* and 24*b* connected to the indoor units C1 and C2 which cool the rooms, are closed, and the valves 32*a* and 32*b* mounted on the second gas refrigerant branch pipelines 25*a* and 25*b* are opened. The valve 31*c* on the first gas refrigerant branch pipeline 24*c* connected to the indoor unit C3 which heats the room is opened, and the valve 32*c* on the second gas refrigerant branch pipeline 25*c* is closed. Therefore, as shown in FIG. 3A, the refrigerant, passed through the third pipeline 4 and introduced into he gas refrigerant pipeline 23 of the distributor 'B', is introduced into the indoor heat exchanger 62*c* in the indoor unit C3 via the first gas refrigerant branch pipeline 24*c*, discharges condensing heat at the indoor heat exchanger 62*c* to heat the room, and introduced into the liquid refrigerant pipeline 21 via the indoor unit expansion device 61*c* in a liquid state. Then, the liquid refrigerant introduced into the liquid refrigerant pipeline 21 heat exchanges with the super cooling heat exchanger 71, and super cooled into liquid fully.

Referring to FIG. 3A, the refrigerant, discharged from the compressor 1 to the liquid refrigerant pipeline 21 in the distributor 'B' via the second pipeline 7, joins with the refrigerant introduced into the liquid refrigerant pipeline 21 after heating the room at the indoor unit C3. Then, the joined refrigerant is super cooled into liquid fully at the super cooling means 70, introduced into the indoor unit expansion devices 61*a* and 61*b* of the indoor units C1 and C2 through the liquid refrigerant branch pipelines 22*a* and 22*b*, vaporized at the indoor heat exchangers 62*a* and 62*b*, to cool the rooms, and introduced into the return pipeline 26 via the second gas refrigerant branch pipeline 25*a* and 25*b*. The refrigerant is introduced from the return pipeline 26 to the fourth pipeline 5 through the third connection pipeline 13, and, therefrom, to the inlet of the compressor 1 via the accumulator 9. In the third operation mode too, the noise and the out of order of the indoor expansion devices 61*a* and 61*b* can be reduced significantly, as entire two phased refrigerant is liquefied fully by the super cooling means 70 before introduction into the indoor heat expansion devices 61*a* and 61*b*.

Figure 3B:
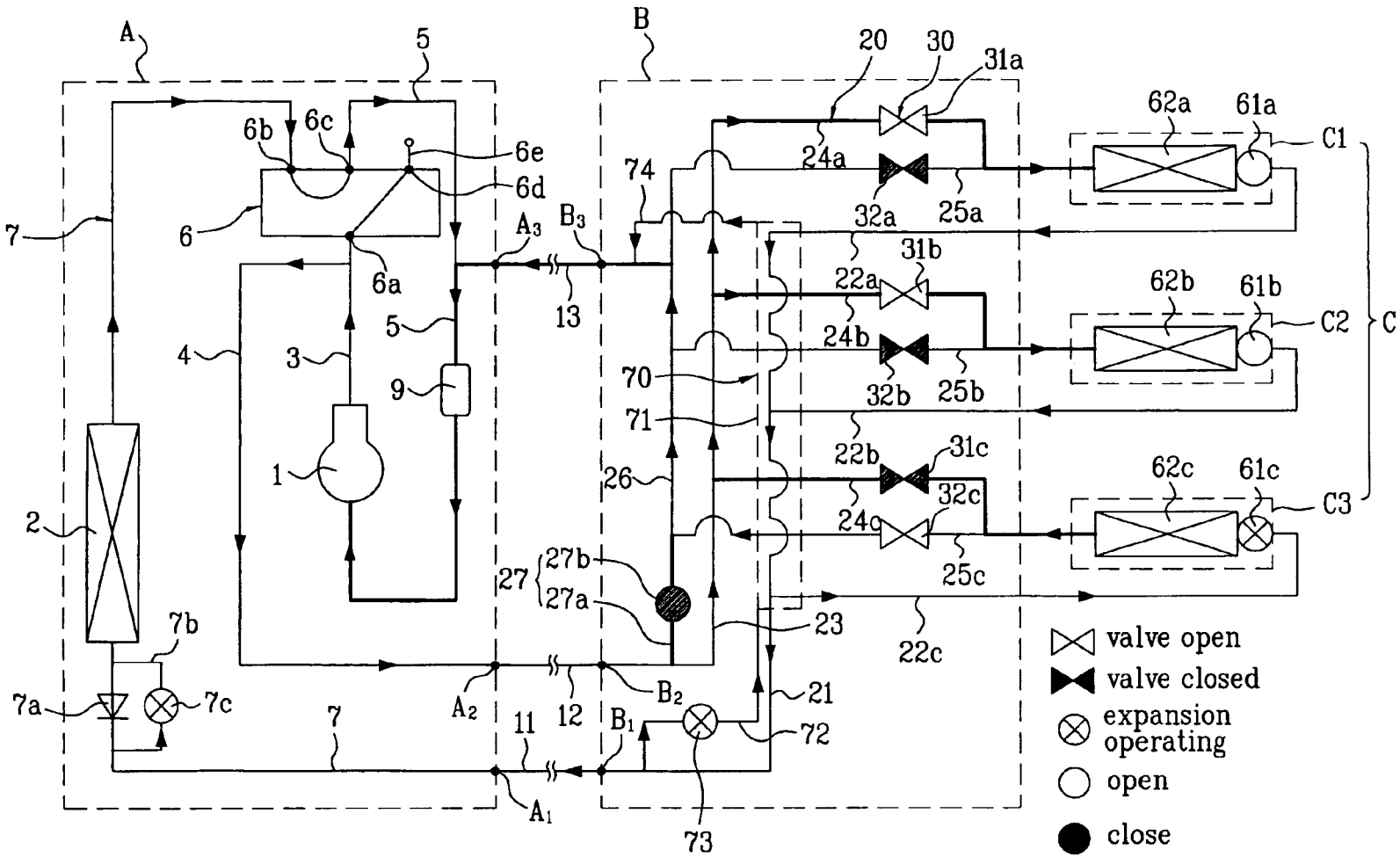
FIG. 3B illustrates a system showing operation of the system in FIG. 1 in heating a major number of rooms and cooing a minor number of rooms.

FIG. 3B illustrates a system showing operation of the system in FIG. 1 in the fourth operation mode. In the fourth operation mode, when a major number of rooms are heated and a minor number of rooms are cooled, the flow path control valve 6 makes the first port 6*a* and the fourth port 6*d* in communication and makes the second port 6*b* and the third port 6*d* in communication. Therefore, entire refrigerant is introduced from the compressor 1 to the distributor 'B' via the third pipeline 4.

In the fourth operation mode, the distributor expansion device 27*b* is closed. The valves 31*a*, and 31*b* on the first gas refrigerant branch pipelines 24*a* and 24*b* connected to the indoor units C1 and C2 which heat the rooms are opened, and the valves 32*a* and 32*b* on the second gas refrigerant branch pipelines are closed. The valve 31*c* on the first gas refrigerant branch pipeline 24*c* connected to the indoor unit C3 which cools the room is closed, and the valve 32*c* on the second gas refrigerant branch pipeline 25*c* is opened. Therefore, the refrigerant introduced into the gas refrigerant pipeline 23 of the distributor 'B' via the second pipeline 7 is introduced into the indoor heat exchangers 62*a* and 62*b* via the first gas refrigerant branch pipelines 24*a* and 24*b*, and flows to the liquid refrigerant pipeline 21 via the liquid refrigerant branch pipelines 22*a* and 22*b* after heating the rooms at the indoor units C1 and C2.

Referring to FIG. 3B, after liquefied fully by the super cooling means 70, a portion of the refrigerant introduced into the liquid refrigerant pipeline 21 is introduced into the liquid refrigerant branch pipelines 22*c* and the other portion of the refrigerant flows toward the first connection pipeline 11. In this instance, the refrigerant introduced into the first connection pipeline 11 is introduced into the fourth pipeline 5 via the second pipeline 7, the parallel pipe piece 7*b*, the outdoor unit expansion device 7*c*, the outdoor heat exchanger 2, and the flow path control valve 6.

The refrigerant introduced into the liquid refrigerant branch pipeline 22*c* passes through the indoor expansion valve 61 and the indoor heat exchanger 62*c* of the indoor unit C3, and cools the room, and, therefrom, introduced into the fourth pipeline 5 via the second gas refrigerant branch pipeline 25*c*, the return pipeline 26, and the third connection pipeline 13. Finally, the refrigerant joined at the fourth pipeline 5 is introduced into the inlet of the compressor 1 via the accumulator 9. In the third mode too, the noise and out of order of the indoor expansion device 61*c* and the outdoor expansion device 7*c* are reduced significantly as the refrigerant liquefied fully by the super cooling means 70 is introduced into the indoor expansion device 61*c* and the outdoor expansion device 7*c*.

As has been described, the multi-type air conditioner of the present invention has the following advantages.

First, the independent cooling or heating of the plurality of rooms can provide an optimal air condition performance proper to an environment of each room.

Second, liquid refrigerant super cooled by the super cooling means is supplied to the indoor and outdoor expansion devices. According to this, the noise, malfunction, and out of order of the indoor and outdoor expansion devices can be reduced significantly. Moreover, cooling/heating performance is improved as the refrigerating efficiency is improved.

In the meantime, a multi-unit air conditioner has been described, in which one outdoor unit, one distributor, and a plurality of indoor units are provided for independent cooling or heating of rooms. It will be apparent to those skilled in the art that various modifications and variations can be made in the present invention without departing from the spirit or scope of the invention. For an example, in the case of the multi-type air conditioner having one outdoor unit and a plurality of indoor units connected to the one outdoor unit directly, all of the plurality of rooms can be heated or cooled. In this case too, it is apparent to persons skilled in this field of art that the super cooling means may be mounted on pipelines connected between the outdoor unit and the indoor units, so that the super cooling means serve the same function as the foregoing embodiments. Thus, it is intended that the present invention cover the modifications and variations of this invention provided they come within the scope of the appended claims and their equivalents.

What is claimed is:

1. A multi-type air conditioner comprising:

an outdoor unit having a compressor, an outdoor heat exchanger, a flow path control valve for controlling a flow path of refrigerant from the compressor, an outdoor expansion device for expanding liquid refrigerant entering the outdoor expansion device in a condensed state via indoor units and for providing the expanded refrigerant to the outdoor heat exchanger when an area is heated, and an outdoor unit piping system;

a plurality of indoor units, each indoor unit having an indoor expansion device, an indoor heat exchanger, and an indoor piping system;

a distributor for selectively distributing refrigerant from the outdoor unit to at least one of the indoor units and returning refrigerant to the outdoor unit according to operation modes;

a super cooling heat exchanger that super cools refrigerant condensed at the outdoor heat exchanger or the indoor heat exchangers and flowing to the indoor expansion devices or to the outdoor expansion device;

a supplementary super cooling heat exchanger mounted on a refrigerant pipeline between the super cooling heat exchanger and the outdoor expansion device;

a first supplementary guide pipe connected between the refrigerant pipeline and one end of the supplementary super cooling heat exchanger;

a supplementary super cooling expansion device on the first supplementary guide pipe; and a second supplementary guide pipe connected between the inlet of the compressor and the other end of the supplementary super cooling heat exchanger.

2. The multi-type air conditioner as claimed in claim 1, wherein the super cooling heat exchanger exchanges heat with a part of a pipeline between the outdoor expansion device and the indoor expansion devices, the pipeline connecting the outdoor heat exchanger, the outdoor expansion device, the indoor expansion devices and the indoor heat exchangers in series.

3. The multi-type air conditioner as claimed in claim 2, wherein the super cooling heat exchanger uses part of the refrigerant flowing through the pipeline between the outdoor expansion device and the indoor expansion devices for super cooling the rest of the refrigerant, the rest of the refrigerant exchanging heat with the super cooling heat exchanger.

4. The multi-type air conditioner as claimed in claim 2, further comprising:

a first guide pipe connected between the refrigerant pipeline and one end of the super cooling heat exchanger for guiding a portion of refrigerant flowing through the refrigerant pipeline after having passed through the outdoor heat exchanger or one of the indoor heat exchangers, a super cooling expansion device mounted on the first guide pipe for expanding the refrigerant flowing through the first guide pipe, and a second guide pipe connected between the inlet of the compressor and the other end of the super cooling heat exchanger for guiding the refrigerant having passed through the super cooling heat exchanger to the compressor.

5. The multi-type air conditioner as claimed in claim 4, wherein the super cooling heat exchanger is tubular and the refrigerant pipeline is located inside the super cooling heat exchanger.

6. The multi-type air conditioner as claimed in claim 4, wherein the super cooling heat exchanger is tubular and passes through an inside of the refrigerant pipeline.

7. The multi-type air conditioner as claimed in claim 2, wherein the super cooling heat exchanger surrounds an outside surface of the refrigerant pipeline.

8. The multi-type air conditioner as claimed in claim 2, wherein the super cooling heat exchanger passes through an inside of the refrigerant pipeline.

9. The multi-type air conditioner as claimed in claim 8, wherein the super cooling heat exchanger includes many bends inside of the refrigerant pipeline for enlarging an area of heat exchange with the refrigerant flowing through the refrigerant pipeline.

10. The multi-type air conditioner as claimed in claim 2, wherein the super cooling heat exchanger includes many bends inside of the refrigerant pipeline for enlarging an area of heat exchange with the refrigerant flowing through the refrigerant pipeline.

11. The multi-type air conditioner as claimed in claim 1, wherein the flow path control valve comprises:

a first port connected to the compressor, a second port connected to the outdoor heat exchanger, a third port connected to an inlet of the compressor, and a fourth port connected to a closed pipe piece or blanked.

12. The multi-type air conditioner as claimed in claim 11, wherein the outdoor unit piping system comprises:

a first pipeline connected between an outlet of the compressor and the first port, a second pipeline connected between the second port and a first port of the outdoor unit, wherein the outdoor heat exchanger is mounted on the second pipeline, a third pipeline connected between the first pipeline and the second pipeline of the outdoor unit, and a fourth pipeline connected between the third port and the inlet of the compressor, and connected to a third port of the outdoor unit.

13. The multi-type air conditioner as claimed in claim 12, wherein the first port of the outdoor unit is connected to a first port of the distributor, a second port of the outdoor unit is connected to a second port of the distributor, and the third port of the outdoor unit is connected to a third port of the distributor.

14. The multi-type air conditioner as claimed in claim 13, wherein the distributor includes;

a distributor piping system for guiding refrigerant from the outdoor unit to the indoor units, and from the indoor units to the outdoor unit, and a valve bank mounted on the distributor piping system for controlling flow of refrigerant flowing through the distributor piping system according to operation modes.

15. The multi-type air conditioner as claimed in claim 14, wherein the distributor piping system comprise:

a liquid refrigerant pipeline connected to the first port of the distributor, a plurality of liquid refrigerant branch pipelines branched from the liquid refrigerant pipeline and connected to the indoor unit expansion devices in the indoor units, a gas refrigerant pipeline connected to the second port of the distributor, a plurality of first gas refrigerant branch pipelines branched from the gas refrigerant pipeline and connected to the indoor heat exchangers of the indoor units, a plurality of second gas refrigerant branch pipelines branched from intermediate points of the first gas refrigerant branch pipelines, and a return pipeline connected to all the second gas refrigerant pipelines and a the third port of the distributor.

16. The multi-type air conditioner as claimed in claim 15, wherein the super cooling heat exchanger is mounted on part of the liquid refrigerant branch pipeline branches for heat exchange with the refrigerant introduced into, or discharged from the outdoor unit.

17. The multi-type air conditioner as claimed in claim 16, wherein the super cooling heat exchanger uses part of the refrigerant flowing through the pipeline between the outdoor expansion device and the indoor expansion devices for super cooling the rest of the refrigerant, the rest of the refrigerant exchanging heat with the super cooling heat exchanger.

18. The multi-type air conditioner as claimed in claim 16, wherein the super cooling heat exchanger surrounds an outside surface of the refrigerant pipeline.

19. The multi-type air conditioner as claimed in claim 16, wherein the super cooling heat exchanger passes through an inside of the refrigerant pipeline.

20. The multi-type air conditioner as claimed in claim 19, wherein the super cooling heat exchanger includes many bends inside of the refrigerant pipeline for enlarging an area of heat exchange with the refrigerant flowing through the refrigerant pipeline.

21. A multi-type air conditioner comprising:

an outdoor unit having a compressor and an outdoor heat exchanger;

a plurality of indoor units, each connected to the outdoor unit directly and each having an indoor expansion device and an indoor heat exchanger; and a super cooling heat exchanger mounted on a refrigerant pipeline between the outdoor heat exchanger and the indoor expansion devices for super cooling refrigerant, the refrigerant pipeline connecting the outdoor heat exchanger, the indoor expansion devices, and the indoor heat exchangers in series;

a supplementary super cooling heat exchanger mounted on the refrigerant pipeline between the super cooling heat exchanger and the outdoor heat exchanger;

a first supplementary guide pipe connected between the refrigerant pipeline and one end of the supplementary super cooling heat exchanger;

a supplementary super cooling expansion device on the first supplementary guide pipe; and a second supplementary guide pipe connected between the inlet of the compressor and the other end of the supplementary super cooling heat exchanger.

22. The multi-type air conditioner as claimed in claim 21, further comprising:

a first guide pipe connected between the refrigerant pipeline and one end of the super cooling heat exchanger for bypassing and guiding a portion of refrigerant flowing through the refrigerant pipeline after having passed through the outdoor heat exchanger or one of the indoor heat exchangers;

a super cooling expansion device mounted on the first guide pipe for expanding the refrigerant flowing through the first guide pipe; and a second guide pipe connected between the inlet of the compressor and the other end of the super cooling heat exchanger for guiding the refrigerant having passed through the super cooling heat exchanger to the compressor.

23. The multi-type air conditioner as claimed in claim 22, wherein the super cooling heat exchanger surrounds an outside surface of the refrigerant pipeline.

24. The multi-type air conditioner as claimed in claim 22, wherein the super cooling heat exchanger passes through an inside of the refrigerant pipeline, and includes many bends inside of the refrigerant pipeline for enlarging an area of heat exchange with the refrigerant flowing through the refrigerant pipeline.

* * * * *

UNITED STATES PATENT AND TRADEMARK OFFICE

CERTIFICATE OF CORRECTION

PATENT NO. : 6,918,264 B2
DATED : July 19, 2005
INVENTOR(S) : J. H. Park et al.

It is certified that error appears in the above-identified patent and that said Letters Patent is hereby corrected as shown below:

Title page,
Item [56], References Cited, FOREIGN PATENT DOCUMENTS, "01181834" should read -- 01/81834 --.

Signed and Sealed this

Twenty-eighth Day of March, 2006

JON W. DUDAS
*Director of the United States Patent and Trademark Office*